United States Patent [19]

Zloczysti et al.

[11] 4,231,360

[45] Nov. 4, 1980

[54] NOSE CLIP FOR RESPIRATORS

[75] Inventors: Stefan Zloczysti; Bernd Woike, both of Berlin, Fed. Rep. of Germany

[73] Assignee: Auergesellschaft GmbH, Berlin, Fed. Rep. of Germany

[21] Appl. No.: 16,898

[22] Filed: Mar. 2, 1979

[30] Foreign Application Priority Data

Jun. 19, 1978 [DE] Fed. Rep. of Germany ..... 2826620

[51] Int. Cl.[3] ..... B63C 11/02

[52] U.S. Cl. ..... 128/201.18; 9/310 A; 24/255 R; D21/237

[58] Field of Search ..... 128/140 N, 140 R, 142 R, 128/142.2, 145 R, 145 A, 147, 198, 206, 346, 132 R, 201.18; 9/329, 310 A, 310 J, 311; 24/255 R, 78, 81 A, 81 AA; D21/237, 238

[56] References Cited

U.S. PATENT DOCUMENTS

| | | | |
|---|---|---|---|
| 2,488,616 | 11/1949 | Browne | 128/346 |
| 4,090,511 | 5/1978 | Gray | 128/142 R |

FOREIGN PATENT DOCUMENTS

| | | | |
|---|---|---|---|
| 427041 | 3/1926 | Fed. Rep. of Germany | 128/346 |

*Primary Examiner*—Henry J. Recla
*Attorney, Agent, or Firm*—Brown, Flick & Peckham

[57] ABSTRACT

A pair of nose pads are connected to the ends of a spring clip that presses the pads against the sides of the nose of the wearer. The connection between the spring and pads is such that the pads can tilt freely relative to the spring clip to avoid discomfort.

2 Claims, 5 Drawing Figures

NOSE CLIP FOR RESPIRATORS

The invention concerns a nose clip for use with respirators, the clip consisting of two nose pads and a spring clip that connects the pads and keeps them pressed in place against the sides of the nose when worn. With nose clips of this type, it is essential that, on the one hand, they effectively close the nose of the respirator wearer and, on the other hand, they seat against the nose sufficiently comfortably. These two requirements are mutually contradictory because the pressure required to close the nose can be quite painful. It has been found that the pain produced by the pressure is caused by the pressure of the spring and its customary rigid attachment to the pressure pads, the faces of which are parallel to each other because the closure pressure exerted on the sides of the nose likewise is produced almost parallel, although the sides of the nose are by no means parallel. It is obvious that the known types of nose clips whose rubber pads are always rigidly fixed to the spring clips cannot be used for the reasons by wearers with differently shaped noses, especially those with broad flat sides, for in every case they are likely to slide off or not close tightly.

The basic task of this invention is to create a nose clip of the type mentioned and to construct it in such a way that it can easily match every shape of nose, especially noses with flat and broad sides, without the closing pressure being changed thereby.

This task is accomplished in accordance with the invention by attaching the nose pads to the spring clip in a way that leaves the pads free to move relative to the spring.

The advantages gained by the invention reside particularly in the fact that the nose clip ensures universal applicability by comparison with conventional nose clips, because it can easily be matched to the most varied shapes of human noses and still close effectively. It will be clear from this that, with the nose clip made in accordance with the invention, there will be an advantageous increase in the safety factor. Moreover, the spring characteristics of the nose clip can be designed so that, with an unchanged nose clip closing pressure, a more comfortable, uniform and painless fit of the nose clip on the nose will be achieved.

The appended drawings illustrate example nose clips made in accordance with this invention, which will be described herein. In the drawings.

Figure 1:
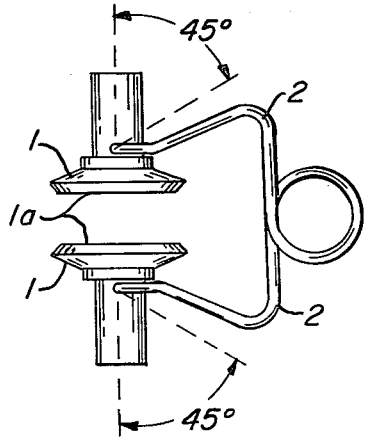
FIG. 1 shows a nose clip in accordance with the invention.
Figure 2:
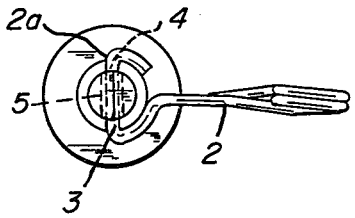
FIG. 2 shows the nose clip from one side.

As may be seen from FIGS. 1 and 2, the nose clip consists essentially of two nose pads 1 and a spring clip 2 that connects them together. In order that the pads can match the most varied nose shapes of the wearers when applied, the two pads are arranged so that they can tilt or rock freely on spring clip 2. This freedom of movement can be attained by bending the free ends 2*a* of the spring clip 2 around to form straight parallel pivot members 3, substantially perpendicular to the plane of the spring, that extend transversely through holes in the integral stems of pads 1. The pads 1 are advantageously made as moldings from plastic, in which case the surfaces 1*a* of the pads that come into contact with the sides of the nose are provided with elastic coatings. In the event that the pads are made entirely of rubber, pivot members 3 of the spring clip 2 may extend through bushings 5 inserted in holes 4 as indicated in FIG. 2.

Figure 5:
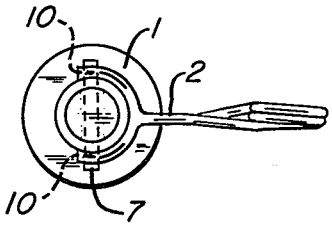
FIG. 5 is a view similar to FIG. 2 of a further embodiment of the invention.

Another form of construction of the nose clip is shown in FIG. 5, in which the free movement of each pad 1 on the spring clip 2 is achieved by making the free ends of the spring clip in the form of forks, each fork end being provided with openings 10 pivotally receiving the ends of a pin 7 that extends through the pad stem and projects a little from it. The pin is parallel to the face of the pad that abuts against the side of the wearer's nose.

Figure 3:
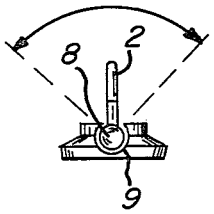
FIG. 3 shows a modification in which a nose clip and pad are connected by a ball and socket joint.
Figure 4:
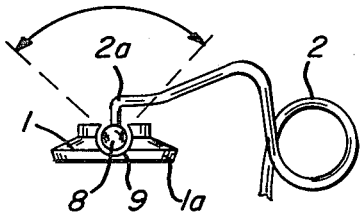
FIG. 4 is a view at 90° to FIG. 3.

As shown in a further embodiment of the invention seen in FIGS. 3 and 4, the freedom of movement of the pads 1 on the spring clip 2 can also be obtained by a ball 8 formed on each end of the spring clip. Each ball is contained in a split socket 9 in a nose pad, thereby forming a ball and socket joint that permits universal movement of the pads relative to the spring clip.

In all of the above-described forms of construction, it is possible to tilt the pads up to about 90° with respect to each other, as a function of the shape of the nose, and this can be done while still obtaining an effective seal for the different noses and with an unchanged closing pressure.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A nose clip for respirators, comprising two pads and a spring clip connecting them together for pressing them against the sides of a wearer's nose when the nose clip is worn, end portions of the spring clip being straight and disposed in parallel relation substantially perpendicular to the plane of the clip, and said pads being provided with transverse holes pivotally receiving said end portions, said holes being located a short distance from the nose-engaging faces of the pads, the connection between the spring and pads permitting the pads to freely tilt relative to the spring clip.

2. A nose clip in accordance with claim 1, in which bushings in said pad holes receive said end portions of the spring clip.

* * * * *